US008590432B2

(12) United States Patent
Wang

(10) Patent No.: US 8,590,432 B2
(45) Date of Patent: Nov. 26, 2013

(54) HANDLE FOR A HAND TOOL

(76) Inventor: Tzu-Chien Wang, Tainan (TW)

( * ) Notice: Subject to any disclaimer, the term of this patent is extended or adjusted under 35 U.S.C. 154(b) by 306 days.

(21) Appl. No.: 13/211,728

(22) Filed: Aug. 17, 2011

(65) Prior Publication Data

US 2013/0042729 A1 Feb. 21, 2013

(51) Int. Cl.
*B25G 1/08* (2006.01)
*B25B 23/16* (2006.01)

(52) U.S. Cl.
USPC ..... 81/177.4; 81/490

(58) Field of Classification Search
USPC ..... 81/177.4, 490, 437–439
See application file for complete search history.

(56) References Cited

U.S. PATENT DOCUMENTS 5,265,504 A * 11/1993 Fruhm ..... 81/439
5,749,271 A * 5/1998 Liu ..... 81/490
6,305,815 B1 * 10/2001 Lin ..... 81/177.4
6,510,768 B2 * 1/2003 Fruhm ..... 81/490
7,395,739 B1 * 7/2008 Chen ..... 81/177.4
7,779,732 B2 * 8/2010 Abel et al. ..... 81/177.4

* cited by examiner

*Primary Examiner* — Hadi Shakeri
(74) *Attorney, Agent, or Firm* — Hershkovitz & Associates, PLLC; Abraham Hershkovitz

(57) ABSTRACT

A handle for a hand tool includes a body, a guider, and a movable assembly. The body has a chamber, a connecting portion, and an opening. The chamber is defined in the body. The connecting portion is defined in the body for assembling a tool bit. The opening is defined in the body and communicating with the chamber. The guider is inserted into the chamber. The guider has a spindle, a first positioner, a second positioner, and multiple guiding fins. The movable assembly includes a clamping seat movably received in the chamber and a puller mounted on the clamping seat. The clamping seat has a through hole, a shoulder, and multiple clamping units. The through hole is defined through the clamping seat for receiving the guider.

15 Claims, 6 Drawing Sheets

HANDLE FOR A HAND TOOL

BACKGROUND OF THE INVENTION

1. Field of the Invention

The present invention relates to a hand tool, and more particularly to a handle for a hand tool to provide a good supporting effect.

2. Description of Related Art

A conventional hand tool handle includes a body and a positioning device. The body is provided for assembling with a tool bit for operation, and the positioning device is provided for receiving multiple tool bits. The body has a cavity defined in the body and an opening defined in an end of the body and communicating with the cavity. The body has a blocker disposed on the body adjacent to the opening. The positioning device includes a seat movably received in the cavity. The seat has a spindle disposed on the seat. The spindle has multiple clamping plates laterally extending from the spindle and a puller disposed on the spindle and exposed out of the body for buckling on the body. Adjacent two of the clamping plates are parallel to each other for clamping a tool bit such that the tool bits are held in the positioning device.

When the puller is pulled out from the body, the seat and the spindle of the positioning device are axially moved with the puller. The seat is stopped by the blocker such that the seat is kept from being detached from the body and the tool bits clamped in the positioning device are exhibited from the body to enable one of the tool bits to be taken from the positioning device for assembling with the body.

However, when the positioning device is partially pulled out from the body, there is not any support arranged between the seat and the body such that the positioning device is easily biased during a pulling movement. Therefore, the conventional positioning device is inconvenient for use. Furthermore, the positioning device is easily damaged or broken when a large force is applied to pull the positioning device, causing the positioning device to bump the blocker on the body.

To overcome the shortcomings, the present invention tends to provide a handle for a hand tool to mitigate or obviate the aforementioned problems.

SUMMARY OF THE INVENTION

The main objective of the invention is to provide an improved handle for a hand tool, which includes a body, a guider, and a movable assembly.

The body has a first end, a second end opposite to the first end, a chamber, a connecting portion, and art opening. The chamber is defined in the body. The connecting portion is defined in the first end of the body for assembling a tool bit. The opening is defined in the second end of the body and communicating with the chamber.

The guider is inserted into the chamber. The guider has a spindle, a first positioner, a second positioner, and multiple guiding fins. The spindle has a first end and a second end opposite to the first end. The first positioner is disposed adjacent to the first end of the spindle. The second positioner is disposed adjacent to the second end of the spindle. The multiple guiding fins radially extend from the spindle and along an axis of the spindle.

The movable assembly includes a clamping seat movably received in the chamber and a puller mounted on the clamping seat.

The clamping seat has a through hole, a shoulder, and multiple clamping units. The through hole is defined through the clamping seat for receiving the guider. The shoulder annularly extends from an inner periphery of the through hole. The multiple clamping units radially extend from the clamping seat.

The puller has an end cap, a positioning shank, multiple guiding slots, an outer buckling portion, and an inner buckling portion.

The end cap is exposed from the body. The positioning shank extends from the end cap and is inserted into the through hole in the clamping seat for receiving the spindle of the guider. The multiple guiding slots are longitudinally defined in the positioning shank for receiving the guiding fins. The outer buckling portion is located on an outer side of the positioning shank and disposed on a free end of the positioning shank that is located opposite to the end cap. The outer buckling portion is buckled on the shoulder of the through hole such that the puller is synchronously moved with the clamping seat. The inner buckling portion is disposed on an inner side of the positioning shank and selectively buckling on one of the first positioner and the second positioner.

The guider provides a supporting effect to the movable assembly when the movable assembly is moved relative to the body, such that the movable assembly is smoothly and stably moved without biasing. The inner buckling portion of the puller can be selectively buckled on the first positioner or the second positioner of the guider, and the tenons are respectively buckled on the mortises to prevent the movable assembly form completely detaching from the body. Therefore, the handle of the present invention provides good positioning and supporting effects.

Other objects, advantages and novel features of the invention will become more apparent from the following detailed description when taken in conjunction with the accompanying drawings.

DETAILED DESCRIPTION OF PREFERRED EMBODIMENT

Figure 1:
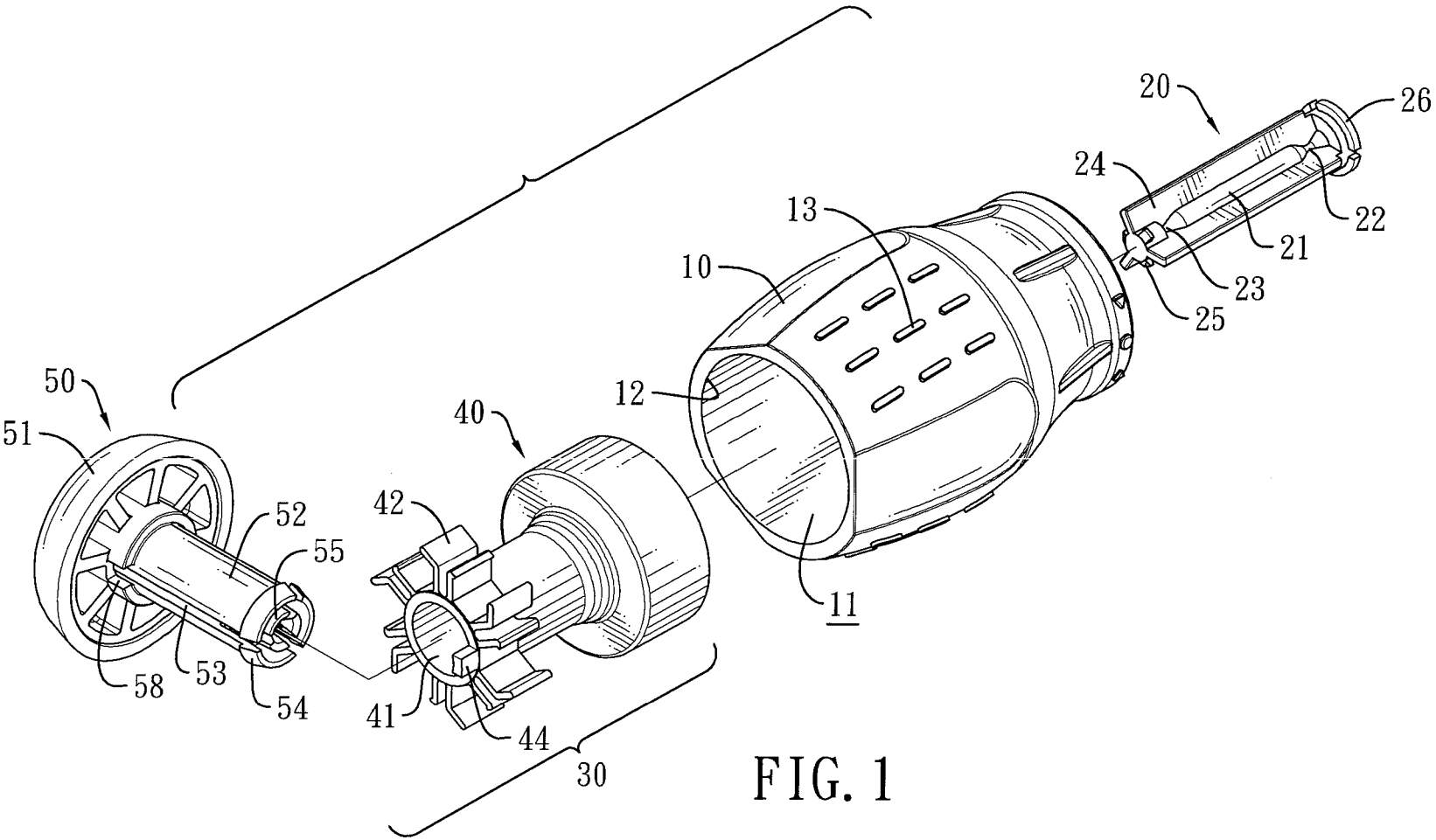
FIG. 1 is an exploded perspective view of a handle for a hand tool in accordance with the present invention.
Figure 2:
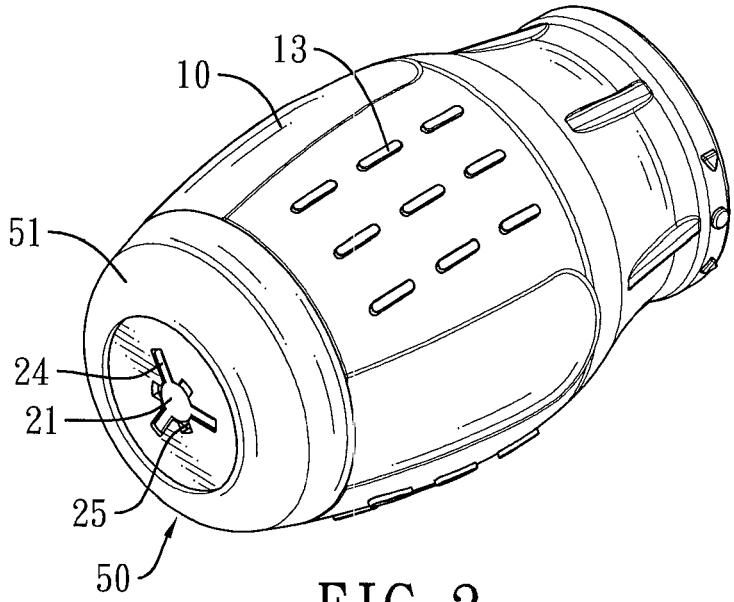
FIG. 2 is a perspective view of the handle in FIG. 1.
Figure 3:
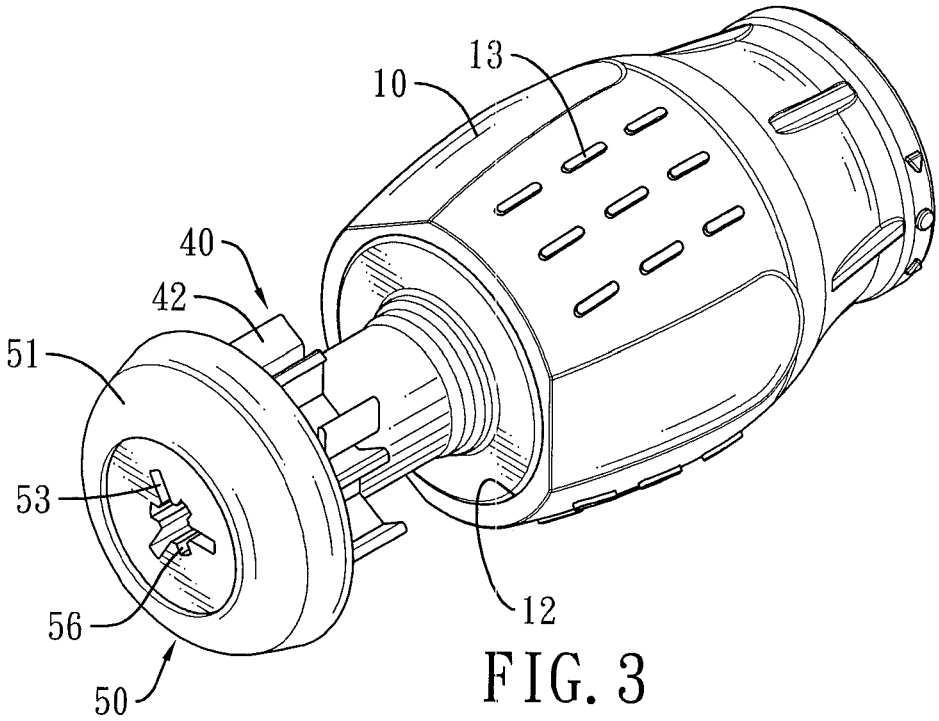
FIG. 3 is an operational perspective view of the handle in FIG. 2.
Figure 4:
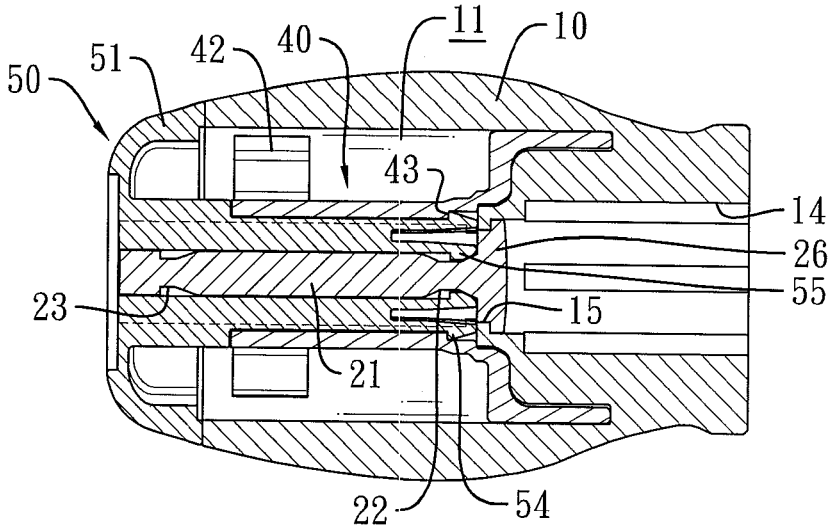
FIG. 4 is a cross-sectional side view of the handle in FIG. 2.
Figure 5:
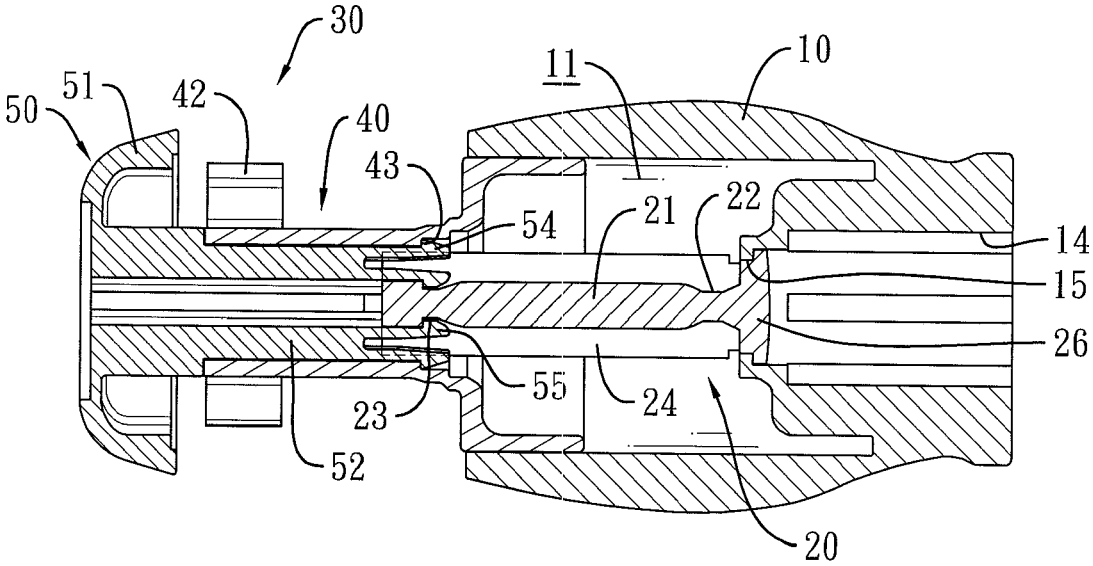
FIG. 5 is an operational cross-sectional side view of the handle in FIG. 2.

With reference to FIGS. 1 to 4, a handle for a hand tool in accordance with the present invention comprises a body 10, a guider 20 and a movable assembly 30.

The body 10 has a first end, a second end opposite to the first end, a chamber 11, a connecting portion 14, an opening 12, an orifice 15, and multiple skidproof portions 13. The chamber 11 is defined in the body 10. The connecting portion 14 may be a polygonal hole and is defined in the first end of the body 10 for assembling with a tool bit. The opening 12 is defined in the second end of the body 10 and communicates with the chamber 11. The orifice 15 is defined through a bottom of the connecting portion 14 for communicating the connecting portion 14 with the chamber 11. The multiple skidproof portions 13 are disposed on an outer surface of the body 10.

The guider 20 is inserted into the chamber 11 from the connecting portion 14 and through the orifice 15. The guider 20 has a spindle 21, a first positioner 22, a second positioner 23, and multiple guiding fins 24. The spindle 21 has a first end and a second end opposite to the first end. The first positioner 22 is disposed adjacent to the first end of the spindle 21. The second positioner 23 is disposed adjacent to the second end of the spindle 21. The multiple guiding fins 24 radially extend from the spindle 21 and along an axis of the spindle 21.

Preferably, the first positioner 22 and the second positioner 23 are curved inward. The spindle 21 has three guiding fins 24 equidistantly and radially extending on an outer surface of the spindle 21. The guider 20 further has a locking sheet 26 and multiple tenons 25. The locking sheet 26 is disposed on the first end of the guider 20 and located adjacent to the first positioner 22. The multiple tenons 25 are disposed on the second end of the spindle 21 adjacent to the second positioner 23, and each tenon 25 is located between adjacent two guiding fins 24.

The movable assembly 30 includes a clamping seat 40 movably received in the chamber 11 and a puller 50 securely connected with the clamping seat 40.

The clamping seat 40 has a through hole 41, a shoulder 43, multiple clamping units 42 and a protrusion 44. The through hole 41 is defined axially through the clamping seat 40 for receiving the guider 20. The shoulder 43 annularly extends from an inner periphery of the through hole 41. The multiple clamping units 42 radially extend from the clamping seat 40. The protrusion 44 longitudinally extends from the clamping seat 40.

The puller 50 has an end cap 51, a positioning shank 52, multiple guiding slots 53, an outer buckling portion 54, an inner buckling portion 55, multiple grooves 56, and a positioning indention 58. The end cap 51 is exposed from the body 10. The positioning shank 52 extends from the end cap 51 and is inserted into the through hole 41 in the clamping seat 40 for receiving the spindle 21 of the guider 20. The multiple guiding slots 53 are longitudinally defined in the positioning shank 52 for receiving the guiding fins 24. The outer buckling portion 54 is located on an outer side of the positioning shank 52 and disposed on a free end of the positioning shank 52 that is located opposite to the end cap 51. The outer buckling portion 54 is buckled on the shoulder 43 of the through hole 41 such that the puller 50 is synchronously moved with the clamping seat 40. The inner buckling portion 55 is disposed on an inner side of the positioning shank 52. The inner buckling portion 55 is selectively buckling on one of the first positioner 22 and the second positioner 23. The multiple grooves 56 are defined in the puller 50 for guiding the tenons 25. The positioning indention 58 is defined in the puller 50, is located adjacent to the end cap 51, and engages the protrusion 44 of the clamping seat 40, such that a position of the puller 50 relative to the clamping seat 40 is locked and the clamping seat 40 is rotated together with the puller 50.

Figure 6:
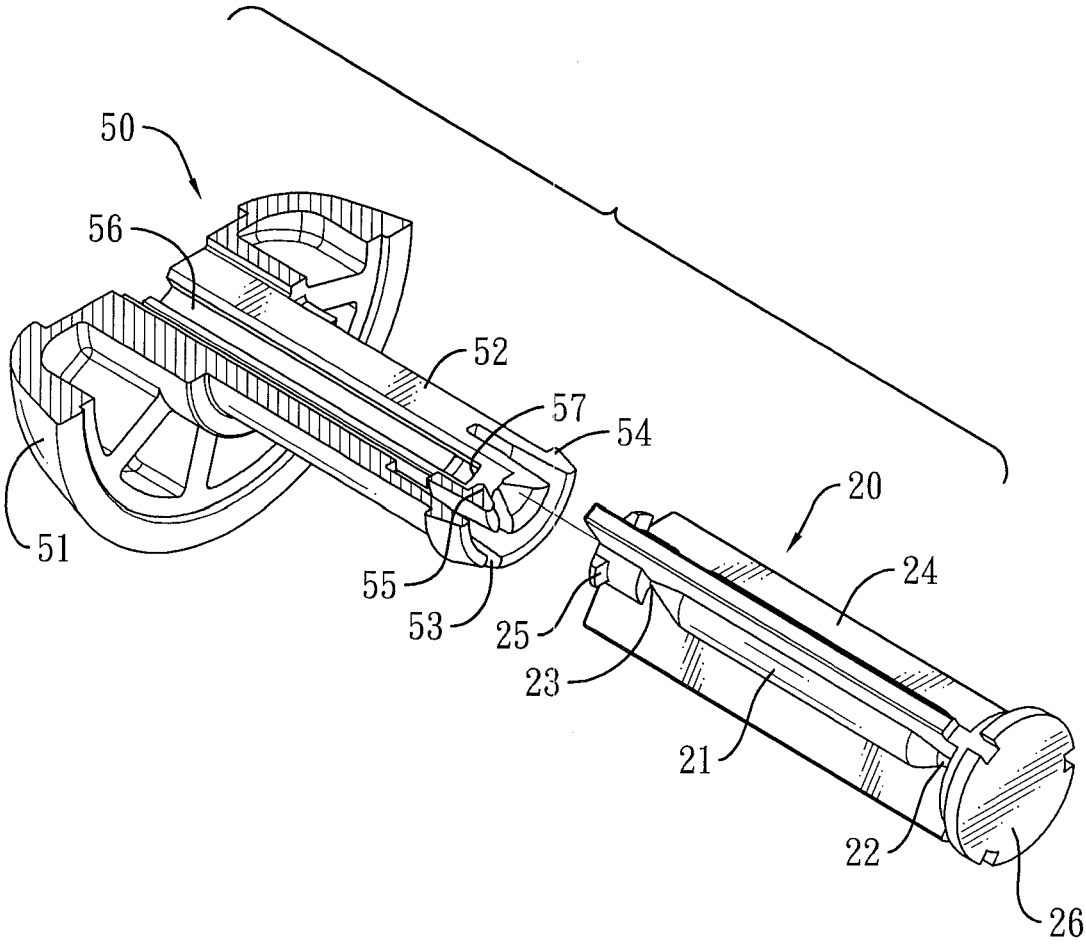
FIG. 6 is an enlarged exploded perspective view in partial section of a puller and a guider of the handle in FIG. 2.
Figure 7:
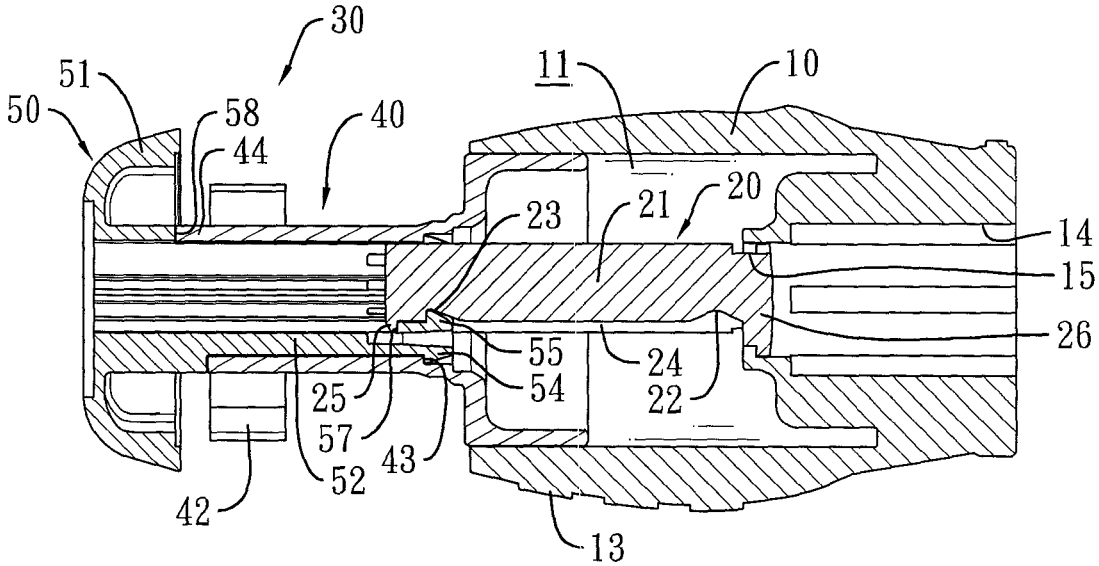
FIG. 7 is another operational cross-sectional side view of the handle in FIG. 2.

With reference to FIG. 6, preferably, the multiple guiding slots 53 are longitudinally defined through the positioning shank 52 and the end cap 51. The multiple grooves 56 are defined through the end cap 51 and the inner buckling portion 55 for allowing the tenons 25 to be movable in the grooves 56. Each groove 56 is located between adjacent two guiding slots 53 and has a mortise 57 defined in an inner surface of the groove 56 for positioning and buckling to a corresponding tenon 25.

With reference to FIGS. 4 to 7, the movable assembly 30 is received in the chamber 11 in the body 10. The inner buckling portion 55 of the puller 50 is buckled on the first positioner 22 of the guider 20 such that the movable assembly 30 is firmly positioned in the body 10. When the puller 50 is pulled out from the body 10, the outer buckling portion 54 of the puller 50 is buckled on the shoulder 43 of the clamping seat 40 such that the clamping seat 40 is pulled by the puller 50. The inner buckling portion 55 of the puller 50 is detached from the first positioner 22 and moved toward the second positioner 23 such that the inner buckling portion 55 is buckled on the second positioner 23. In the meanwhile, the tenons 25 of the guider 20 are respectively buckled on the mortises 57 of the puller 50 such that the movable assembly 30 is locked in position and the clamping units 42 of the clamping seat 40 are exposed from the body 10. The guider 20 is located in the body 10 and supports the movable assembly 30.

Figure 8:
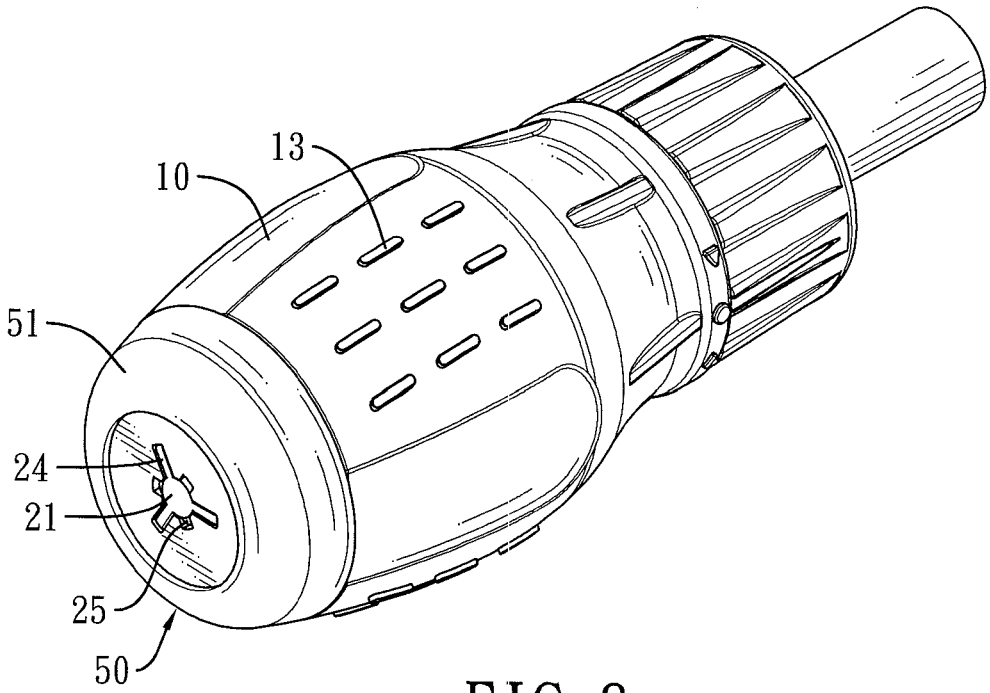
FIG. 8 is an operational perspective view of the handle in FIG. 2 utilized on a hand tool.

With further reference to FIG. 8, the connecting portion 14 of the body 10 is provided for assembling with a tool bit, and the clamping units 42 of the clamping seat 40 are provided for storing spare tool bits. When the movable assembly 30 is received in the body 10, the spare tool bits are received in the chamber 11 in the body 10. The movable assembly 30 is positioned by the engagement between the inner buckling portion 55 and the first positioner 22.

When the spare tool bits are picked up, or when the tool bit on the connecting portion 14 is received in the clamping units 42, the puller 50 is pulled out together with the clamping seat 40 such that the clamping units 42 are exposed from the body 10. The puller 50 is stably moved along the spindle 21 of the guider 20 due to the guiding fins 24 respectively engaging the guiding slots 53 and the tenons 25 respectively engaging the grooves 56. When the inner buckling portion 55 of the puller 50 is detached form the first positioner 22 and buckled on the second positioner 23, the inner buckling portion 55 engages the second positioner 23 to prevent the movable assembly 30 from completely detaching from the body 10 and damaging a structure of the handle of the present invention.

After an external force is applied on and pushes the movable assembly 30 to detach the inner buckling portion 55 from the second positioner 23, the inner buckling portion 55 is moved toward the first positioner 22 and buckled on the first positioner 22, such that the movable assembly 30 can be easily received and locked in the body 10.

During the movement of the movable assembly 30, the guider 20 provides a sustained support to the movable assembly 30 to keep the movable assembly 30 in smoothness and stability. The inner buckling portion 55 of the puller 50 can selectively buckle the first positioner 22 or the second positioner 23, and the tenon 25 is able to be engaged the mortise, such that the movable assembly 30 is stopped at a stroke and automatically locked to provide a buckling click to notify a user and to prevent the puller 50 from over-pulling.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A handle for a hand tool comprising:

a body having a chamber defined in the body; and an opening defined in one end of the body and communicating with the chamber;

a guider mounted in the body, inserted into the chamber and having a spindle having a first end and a second end opposite to the first end;

a first positioner disposed adjacent to a first end of the spindle;

a second positioner disposed adjacent to a second end of the spindle; and multiple guiding fins radially extending from the spindle and along an axis of the spindle; and a movable assembly movably mounted in the body and having a clamping seat received in the chamber and having a through hole defined through the clamping seat for receiving the guider;

a shoulder extending from an inner periphery of the through hole; and multiple clamping units radially extending from the clamping seat; and a puller mounted on the clamping seat and having an end cap exposed from the body;

a positioning shank extending from the end cap and inserted into the through hole in the clamping seat for receiving the spindle of the guider;

multiple guiding slots longitudinally defined in the positioning shank for receiving the guiding fins;

an outer buckling portion located on an outer side of the positioning shank and disposed on a free end of the positioning shank that is located opposite to the end cap for buckling the shoulder of the through hole; and an inner buckling portion disposed on an inner side of the positioning shank for selectively buckling on one of the first positioner and the second positioner.

2. The handle for a hand tool as claimed in claim 1, wherein the guider has multiple tenons disposed on the second end of the spindle adjacent to the second positioner, and each tenon is located between adjacent two of the guiding fins; and the puller has multiple grooves defined in the puller for guiding the tenons, and each groove has a mortise defined in an inner surface of the groove for buckling to a corresponding tenon.

3. The handle for a hand tool as claimed in claim 2, wherein the guider has a locking sheet disposed on the first end of the guider and located adjacent to the first positioner.

4. The handle for a hand tool as claimed in claim 3, wherein the clamping seat has a protrusion longitudinally extending from the clamping seat; and the puller has a positioning indention defined in the puller and located adjacent to the end cap for receiving the protrusion.

5. The handle for a hand tool as claimed in claim 4, wherein the body has multiple skidproof portions disposed on an outer surface of the body.

6. The handle for a hand tool as claimed in claim 3, wherein the body has multiple skidproof portions disposed on an outer surface of the body.

7. The handle for a hand tool as claimed in claim 2, wherein the clamping seat has a protrusion longitudinally extending from the clamping seat; and the puller has a positioning indention defined in the puller and located adjacent to the end cap for receiving the protrusion.

8. The handle for a hand tool as claimed in claim 7, wherein the body has multiple skidproof portions disposed on an outer surface of the body.

9. The handle for a hand tool as claimed in claim 2, wherein the body has multiple skidproof portions disposed on an outer surface of the body.

10. The handle for a hand tool as claimed in claim 1, wherein the guider has a locking sheet disposed on the first end of the guider and located adjacent to the first positioner.

11. The handle for a hand tool as claimed in claim 10, wherein the clamping seat has a protrusion longitudinally extending from the clamping seat; and the puller has a positioning indention defined in the puller and located adjacent to the end cap for receiving the protrusion.

12. The handle for a hand tool as claimed in claim 11, wherein the body has multiple skidproof portions disposed on an outer surface of the body.

13. The handle for a hand tool as claimed in claim 1, wherein the clamping seat has a protrusion longitudinally extending from the clamping seat; and the puller has a positioning indention defined in the puller and located adjacent to the end cap for receiving the protrusion.

14. The handle for a hand tool as claimed in claim 13, wherein the body has multiple skidproof portions disposed on an outer surface of the body.

15. The handle for a hand tool as claimed in claim 1, wherein the body has multiple skidproof portions disposed on an outer surface of the body.

* * * * *